US009599415B1

(12) United States Patent
Michlin

(10) Patent No.: US 9,599,415 B1
(45) Date of Patent: Mar. 21, 2017

(54) BREECH ASSEMBLY WITH EXPANDABLE MANDREL

(71) Applicant: U.S. Army Research Laboratory, Adelphi, MD (US)

(72) Inventor: Alexander E. Michlin, Whiteford, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/051,690

(22) Filed: Feb. 24, 2016

Related U.S. Application Data

(60) Provisional application No. 62/216,406, filed on Sep. 10, 2015.

(51) Int. Cl.
*F41A 3/00* (2006.01)
*F41A 3/30* (2006.01)
*F41C 3/00* (2006.01)

(52) U.S. Cl.
CPC . *F41A 3/30* (2013.01); *F41C 3/00* (2013.01)

(58) Field of Classification Search
USPC ..... 42/16, 15, 14, 69.02; 89/181, 187.01, 89/190, 189
See application file for complete search history.

(56) References Cited

U.S. PATENT DOCUMENTS

2002/0020097 A1* 2/2002 Murello ..... F41A 3/26 42/16
2005/0217473 A1* 10/2005 Murello ..... F41A 5/24 89/187.01
2014/0251118 A1* 9/2014 Moretti ..... F41A 3/20 89/23

* cited by examiner

*Primary Examiner* — J. Woodrow Eldred
(74) *Attorney, Agent, or Firm* — Alan I. Kalb

(57) ABSTRACT

A breech assembly for a gun having a barrel and a barrel extension extending rearwardly from the barrel. The barrel extension includes a throughbore aligned with the barrel as well as a radially inwardly extending annular abutment surface adjacent the rear end of the barrel extension. An elongated bolt is axially slidably received through the barrel extension throughbore when moved to a firing position. An expandable mandrel is mounted to the bolt so that the mandrel surrounds at least a portion of the bolt. An expansion pin is slidably mounted on the bolt and movable between a retracted position in which the mandrel collapses onto the bolt and allows removal of the bolt from the barrel extension, and an inserted position in which at least a portion of the expansion pin is inserted into the mandrel and deflects the mandrel radially outwardly so that a rear end of the mandrel abuts against the abutment surface and locks the bolt to the barrel extension.

6 Claims, 2 Drawing Sheets

BREECH ASSEMBLY WITH EXPANDABLE MANDREL

GOVERNMENT INTEREST

The invention described herein may be manufactured, used, and licensed by or for the United States Government.

BACKGROUND OF THE INVENTION

I. Field of the Invention

The present invention relates generally to firearms and, more particularly, to a breech assembly for automatic and semiautomatic small arms.

II. Description of Related Art

There are many automatic and semiautomatic small arm rifles that are used both in military applications as well as for civilian use. These previously known automatic and semiautomatic weapons include a bolt which reciprocates between a load position and a firing position for each shot that is fired. In its load position, the bolt is retracted from the barrel which both ejects the casing from the previously fired cartridge and also allows a new cartridge to be loaded from an ammunition magazine into a load chamber behind the gun breech.

The subsequent forward movement of the bolt to its firing position loads the cartridge into the breech and the bolt is then locked into position. Upon firing of the shot, the bolt supports the full load from the firing of the cartridge. After the cartridge has been fired, the bolt unlocks and moves to its retracted or load position in which the casing is ejected, a new cartridge is loaded into the load chamber behind the breech, and the above process is repeated.

Most of today's automatic and semiautomatic rifles use a locking lug style breech to lock the bolt to the rifle when it is fired. In a locking lug style breech, the bolt includes a plurality of radial protrusions that are attached to the bolt. These protrusions pass through mating protrusions on the barrel or barrel extension and the locking lugs and the bolt are then rotated to align with the protrusions on the barrel or barrel extension. Given this geometry, however, the locking lugs can have no more than a 50% load bearing support with the rifle. This, in turn, requires that the bolt as well as the protrusions in the barrel or barrel extension of the rifle have a minimum size in order to adequately support the load when the rifle is fired.

SUMMARY OF THE PRESENT INVENTION

The present invention provides a breech assembly particularly suited for automatic and semiautomatic small arm guns which overcomes the above mentioned disadvantages of the previously known breech assemblies.

In brief, the breech assembly of the present invention includes a breech which is adapted to receive the cartridge to be fired by the gun. Typically, the cartridge is received automatically from a magazine which holds the cartridges.

A barrel extension extends longitudinally outwardly from the rear end of the gun barrel. The barrel extension includes a throughbore aligned with the barrel and a radially inwardly extending annular abutment surface adjacent at the rear end of the barrel extension.

An elongated bolt is longitudinally slidably aligned with the barrel extension throughbore. In operation, the bolt reciprocates between a retracted or loading position behind the barrel extension to eject a spent casing and receive a new round from the magazine, and a forward or firing position in which the bolt extends through the barrel extension and loads a new cartridge into the breech. An elongated and radially expandable mandrel is mounted to the bolt so that the mandrel surrounds at least a portion of the bolt. This mandrel includes a plurality of axially extending slots which extend between the front and rear ends of the mandrel.

An expansion pin is slidably mounted to the bolt and is movable between a retracted or loading position in which the mandrel collapses on the bolt to allow the retraction of the bolt from the barrel extension to the loading position, and a firing position in which at least a portion of the expansion pin is inserted into the mandrel and deflects at least the rear end of the mandrel outwardly. In doing so, a rear end of the mandrel abuts against the abutment surface formed on the barrel extension thus locking the bolt to the barrel extension to enable firing of the cartridge.

Since the entire rear end of the mandrel abuts against the abutment surface formed in the barrel extension, an increased surface of contact between the mandrel and the barrel extension as compared to the previously known lug breech assemblies is effected thus improving the load bearing support and reducing the required size of the bolt.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
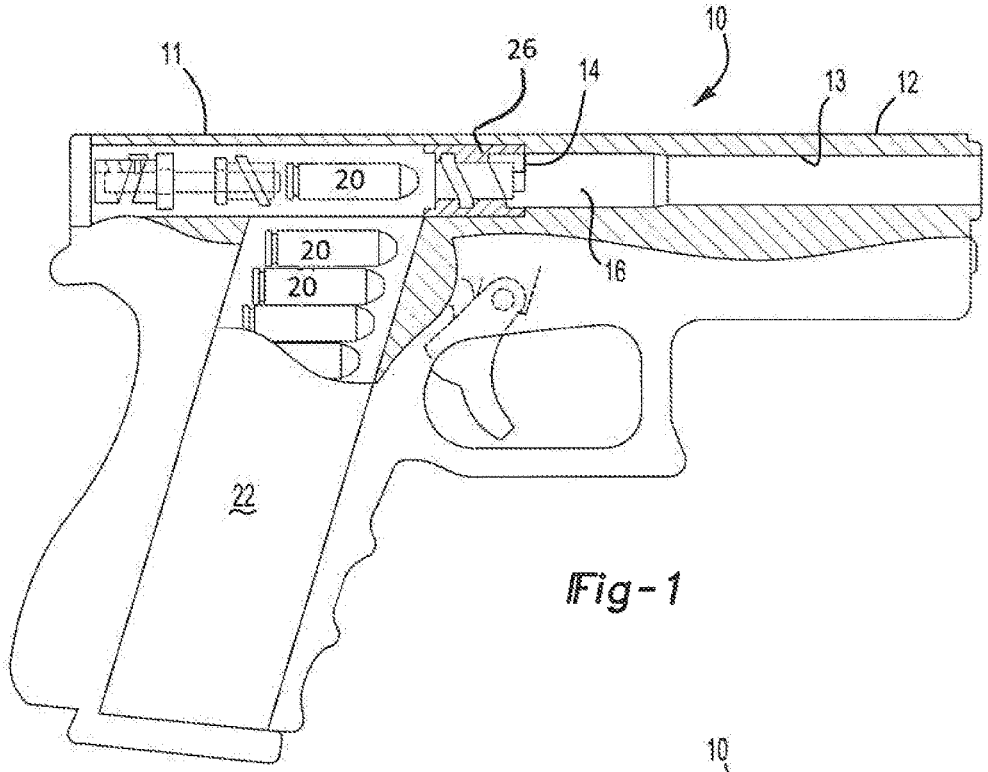
FIG. 1 is a partial sectional view illustrating the breech assembly of the present invention in the loading position.

With reference first to FIGS. 1-4, a breech assembly 10 according to the present invention is shown for use with an automatic or semiautomatic rifle 12, including handguns. In the conventional fashion, the rifle 12 includes a barrel 14 having an elongated throughbore 16 through which bullets 18 from cartridges 20 are fired. Also in the conventional fashion, the cartridges 20 are contained within a magazine 22 (FIG. 1) and sequentially loaded into a breech 24 as the rifle 12 is fired.

A barrel extension 26 extends rearwardly from the barrel 14 and includes a tapered throughbore 28 aligned with the rifle bore 16. A radially inwardly extending annular abutment surface 30 (FIG. 3) is formed adjacent at the rear end 32 of the barrel extension 26, i.e. the end opposite from the rifle bore 16.

Figure 3:
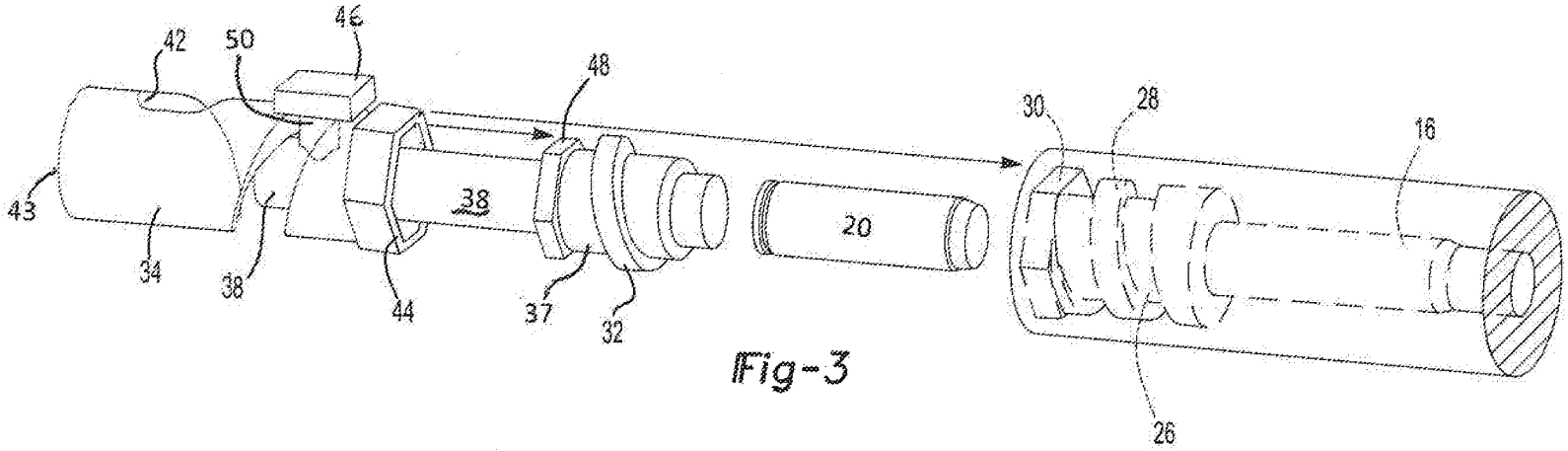
FIG. 3 is a longitudinal sectional view similar to FIG. 2, but illustrating the bolt in the locked position.

A bolt 34 having an enlarged diameter head 36 and an elongated cylindrical body 37 is reciprocally mounted to the rifle 12 between a loading position, shown in FIG. 1, and a firing position, shown in FIG. 3. In its loading position the bolt 34 is retracted from the barrel extension 26 which both ejects the spent casing and also allows a new cartridge to be loaded in front of the bolt 34 and behind the barrel extension 26. Thereafter, the movement of the bolt 34 to its firing position forces the cartridge 20 through the barrel extension 26 and into the breech 24 in preparation for firing.

Figure 4:
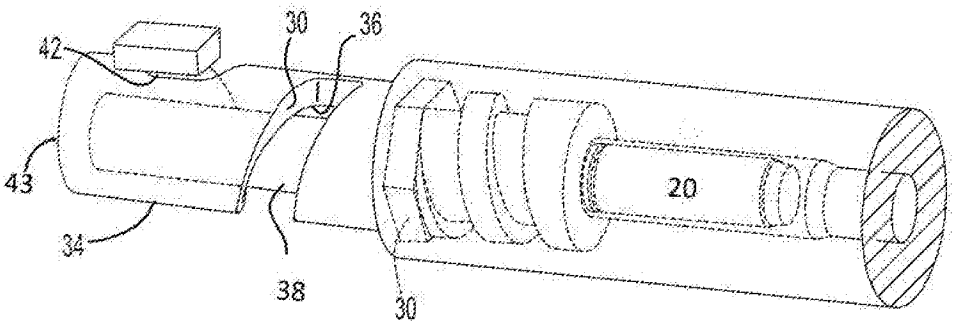
FIG. 4 is an exploded perspective view of the breech assembly.

With reference now particularly to FIG. 4, a mandrel 38 is disposed around the bolt body 37 behind the bolt head 36. A plurality of circumferentially spaced and axially extending slots 42 are formed through the mandrel 38 and each slot 42 is alternatively open at its front and rear ends 43 and 44, respectively.

Figure 2:
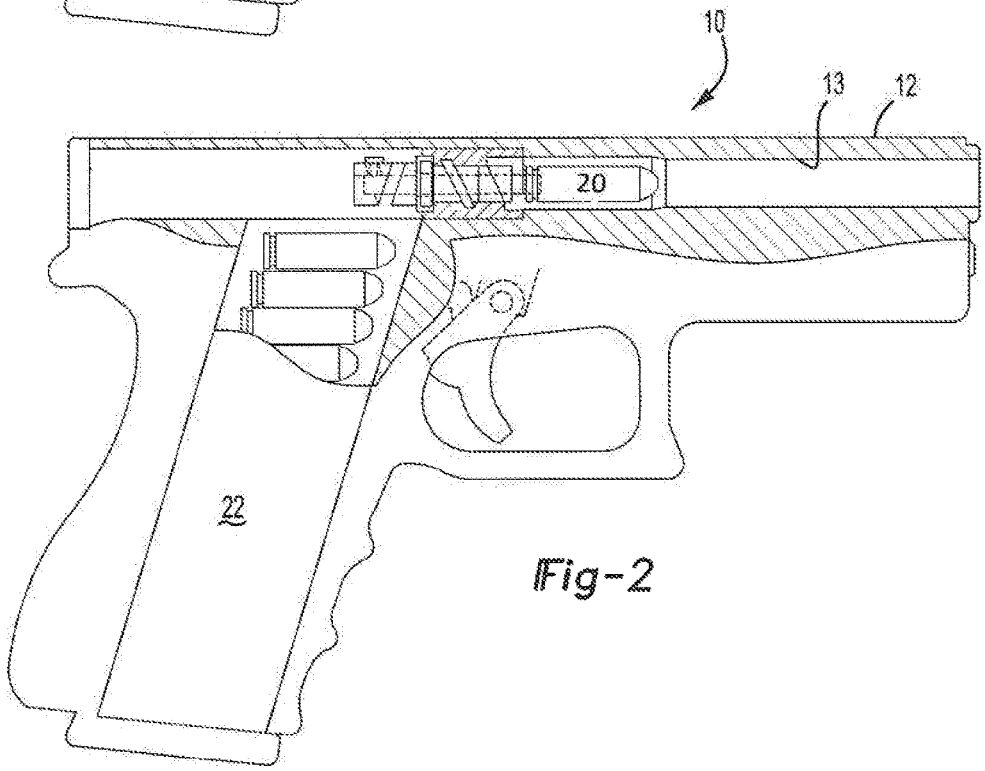
FIG. 2 is a longitudinal sectional view of the breech assembly with the bolt in the firing position but unlocked position.

The mandrel 38 is formed of a compliant material, such as steel, so that with the mandrel 38 in an at-rest state shown in FIGS. 1 and 2, the mandrel 38 collapses around the bolt body 37. In doing so, the overall diameter of the mandrel 38 is less than the diameter of the throughbore 28 in the barrel extension 26. Consequently, the bolt 34 with the mandrel 38 in its collapsed position may be axially inserted into and removed from the throughbore 28 in the barrel extension 26.

With reference to FIGS. 3 and 4, in order to lock the bolt 34 to the barrel extension 26 to enable firing of the cartridge 20 loaded in the breech, an expansion pin 46 is slidably mounted over a rear end 48 of the bolt body 37, and this expansion pin 46 includes a conical outer surface 50. Consequently, as the expansion pin 46 is moved axially over the bolt body 37 towards the bolt head 36, the outer conical surface 50 of the expansion pin 46 expands the mandrel 38 radially outwardly as shown in FIG. 3. In doing so, the rear end 44 of the mandrel 38 is aligned with and abuts against the abutment surface 30 in the barrel extension 26. With the mandrel 38 and the bolt 34 locked to the barrel extension 26, the cartridge 20 can be fired and the bolt 34 will support the firing load.

In operation, with the bolt 34 retracted to its loading position (FIG. 1), i.e. removed from the barrel extension 26, the previously spent casing is ejected and a new cartridge is loaded into the loading chamber behind the barrel extension 26. At this time the mandrel 38 is in its collapsed position.

The bolt 34 then shifts longitudinally forwardly to its firing position as shown in FIG. 2 thus loading the cartridge into the breech. The expansion pin 46 then shifts forwardly as shown in FIG. 3 thus expanding the mandrel 38 and locking the bolt 34 to the barrel extension 26. The cartridge 20 is then fired with the bolt 34 and mandrel 38 supporting the force or load of the firing. The expansion pin 46 is then moved to its retracted position (FIG. 2) thereby allowing the mandrel 38 to collapse and the bolt 34 to be retracted to its loading position whereafter the above process is repeated.

From the foregoing, it can be seen that, since the area of contact between the mandrel 38 and the barrel extension 26 is much greater than 50%, the present invention achieves a greater load bearing support than with the previously known breech assemblies with a smaller bolt and smaller breech assembly.

Having described my invention, however, many modifications thereto will become apparent to those skilled in the art to which it pertains without deviation from the spirit of the invention as defined by the scope of the appended claims.

I claim:

1. A breech assembly for a gun having a barrel comprising:

a barrel extension aligned with and extending rearwardly from the barrel, said barrel extension having a radially inwardly annular abutment surface adjacent a rear end of the barrel extension, an elongated bolt axially slidably movable between a loading position in which a cartridge is loaded between the bolt and the barrel extension, and a firing position in which the cartridge is loaded into the barrel extension and the bolt extends into the barrel extension and abuts against the cartridge, an elongated expandable mandrel mounted to said bolt so that said mandrel surrounds at least a portion of said bolt, an expansion pin slidably mounted on said bolt and movable between a retracted position in which said mandrel collapses on said bolt to allow the removal of said bolt from said barrel extension, and a position in which at least a portion of said expansion pin is inserted into said mandrel and deflects said mandrel outwardly so that a rear end of said mandrel abuts against said abutment surface in said barrel extension to thereby lock said bolt to said barrel extension.

2. The breech assembly as defined in claim 1 wherein said mandrel is cylindrical in shape and has a plurality of circumferentially spaced and axially extending slots.

3. The breech assembly as defined in claim 2 wherein said slots are alternatively open at a front and a rear end of said mandrel.

4. The breech assembly as defined in claim 1 wherein said expansion pin has a conical outer surface.

5. The breech assembly as defined in claim 1 wherein said mandrel is attached to said bolt.

6. The breech assembly of claim 1 wherein said mandrel is made of a compliant material.

* * * * *